US007631993B2

(12) United States Patent
Russello et al.

(10) Patent No.: US 7,631,993 B2
(45) Date of Patent: Dec. 15, 2009

(54) FRONT TRIM RING FOR A VANDAL RESISTANT LUMINAIRE

(75) Inventors: Thomas Russello, Freehold, NJ (US); Dylan A. Akinrele, Leonia, NJ (US); David S. Monteiro, Belleville, NJ (US); Kenneth W. Biello, Stroudsbourg, PA (US)

(73) Assignee: Genlyte Thomas Group LLC, Burlington, MA (US)

( * ) Notice: Subject to any disclaimer, the term of this patent is extended or adjusted under 35 U.S.C. 154(b) by 248 days.

(21) Appl. No.: 11/741,311

(22) Filed: Apr. 27, 2007

(65) Prior Publication Data

US 2007/0253204 A1 Nov. 1, 2007

Related U.S. Application Data

(60) Provisional application No. 60/745,900, filed on Apr. 28, 2006.

(51) Int. Cl.
*F21V 15/00* (2006.01)
*F21V 21/00* (2006.01)

(52) U.S. Cl. ..... 362/374; 362/362; 362/375; 362/376; 362/390; 362/445

(58) Field of Classification Search ..... 362/374, 362/375, 376, 290, 390, 455, 362.374
See application file for complete search history.

(56) References Cited

U.S. PATENT DOCUMENTS

| | | | |
|---|---|---|---|
| 1,215,894 | A | 2/1917 | Yuyama |
| D051,774 | S | 2/1918 | Coppinger |
| 1,356,145 | A | 10/1920 | Hawthorne |
| 1,486,745 | A | 3/1924 | Heselton |
| 1,545,711 | A | 7/1925 | Townsend |
| 1,639,753 | A | 8/1927 | Shelton |
| 2,075,199 | A | 3/1937 | Homer |
| D104,401 | S | 5/1937 | Kanter |
| 2,132,784 | A | 10/1938 | Guth |
| D114,805 | S | 5/1939 | Brooks |
| D115,417 | S | 6/1939 | McCann |
| D137,508 | S | 3/1944 | Asay |
| 2,632,095 | A | 3/1953 | Dove |
| D172,522 | S | 6/1954 | Stone |
| 2,732,484 | A | 1/1956 | Lipscomb |
| D178,282 | S | 7/1956 | Runtz |
| 2,767,305 | A | 10/1956 | Onksen etal. |
| 2,853,599 | A | 9/1958 | Kliegl |
| D190,385 | S | 5/1961 | Schreckengost |
| D199,142 | S | 9/1964 | Daum |
| D199,144 | S | 9/1964 | Daum |
| D202,212 | S | 9/1965 | Izzi |
| D217,638 | S | 5/1970 | Magi |

(Continued)

*Primary Examiner*—Stephen F Husar
*Assistant Examiner*—James W Cranson
(74) *Attorney, Agent, or Firm*—Middleton & Reutlinger; John F. Salazar

(57) ABSTRACT

A trim ring for a vandal resistant luminaire, the trim ring is disposed about an electrical component housing and a lens and holds the lens to the electrical component housing. The trim ring is designed to protect the luminaire by absorbing physical shock exerted on the luminaire and provide an aesthetic pleasing design. Twist locks depend from an inner annular surface of the trim ring which cooperate with retaining legs on the electrical component housing providing for access to the internal components of the vandal resistant luminaire.

16 Claims, 9 Drawing Sheets

U.S. PATENT DOCUMENTS

D222,103 S 9/1971 Anderson
3,610,915 A 10/1971 Moore
3,666,935 A 5/1972 Pritchett et al.
3,711,702 A 1/1973 Adra
3,755,665 A 8/1973 Grindle
D229,713 S 12/1973 Wince et al.
D231,406 S 4/1974 Biallo
3,840,735 A * 10/1974 Chan ..... 362/267
3,895,227 A 7/1975 Murray et al.
3,919,542 A 11/1975 Castic
4,029,953 A * 6/1977 Natoli ..... 362/382
D246,330 S 11/1977 Krase et al.
4,141,061 A 2/1979 Ford et al.
4,164,784 A 8/1979 Jaksich
4,288,846 A 9/1981 Fletcher et al.
D262,914 S 2/1982 Kristofek
4,323,953 A 4/1982 Hutchison
4,323,954 A 4/1982 Florence et al.
D267,516 S 1/1983 Rambusch et al.
D272,193 S 1/1984 Sangiamo
4,434,455 A 2/1984 Merritt
4,447,863 A 5/1984 Fenne
4,519,018 A 5/1985 Rowland
4,602,320 A 7/1986 Tomkin et al.
D286,206 S 10/1986 Joosten et al.
D286,446 S 10/1986 Caroli et al.
4,695,930 A 9/1987 Wierzbicki et al.
4,709,312 A 11/1987 Heinisch et al.
D294,066 S 2/1988 Ewing et al.
4,760,499 A 7/1988 Il
4,816,969 A 3/1989 Miller
D301,175 S 5/1989 Benjamin
4,827,386 A 5/1989 Mackiewicz
D302,326 S 7/1989 DiCola
D302,327 S 7/1989 DiCola
D302,328 S 7/1989 Fretz
D302,329 S 7/1989 Fretz et al.
D302,330 S 7/1989 Fretz
4,858,091 A 8/1989 Fouke
D305,694 S 1/1990 Brown
D309,956 S 8/1990 Sikora et al.
D315,612 S 3/1991 Hughes et al.
D316,457 S 4/1991 De'Armond
5,047,907 A 9/1991 Hawkins
D321,408 S 11/1991 Hughes et al.
D323,897 S 2/1992 Compton
5,086,379 A 2/1992 Denison et al.
5,158,348 A 10/1992 Sakamoto et al.
5,174,648 A 12/1992 Clary et al.
D336,536 S 6/1993 Shaanan et al.
D336,964 S 6/1993 Janssen et al.
D337,835 S 7/1993 Donato et al.
D338,980 S 8/1993 Dieperink
D343,245 S 1/1994 Fouke et al.
D343,250 S 1/1994 Fouke et al.
D343,251 S 1/1994 Fouke et al.
5,278,737 A 1/1994 Luce et al.
D344,606 S 2/1994 Fouke et al.
D345,432 S 3/1994 Gruber et al.
D345,433 S 3/1994 Gruber et al.
D345,434 S 3/1994 Gruber et al.
D346,874 S 5/1994 Fiorato
D347,292 S 5/1994 Roos et al.
D347,486 S 5/1994 Gruber et al.
D348,531 S 7/1994 Mehaffey et al.
5,357,413 A 10/1994 Mandall
D352,124 S 11/1994 Russello et al.
5,377,087 A 12/1994 Yoon
D354,580 S 1/1995 Fouke et al.
D355,044 S 1/1995 Russello et al.
D357,761 S 4/1995 Dewinter
5,404,297 A 4/1995 Birk et al.
D358,898 S 5/1995 Compton
D358,902 S 5/1995 Webster, III
5,416,683 A 5/1995 McCarty
5,416,684 A 5/1995 Pearce
D364,242 S 11/1995 Fiorato
D370,228 S 5/1996 Chapman et al.
5,584,574 A 12/1996 Haddad
5,597,234 A 1/1997 Winkelhake
D377,990 S 2/1997 Nakano
5,642,934 A 7/1997 Haddad
5,662,413 A 9/1997 Akiyama
5,671,997 A 9/1997 Potts
D385,643 S 10/1997 Brohard et al.
D390,999 S 2/1998 Gaskins et al.
D391,659 S 3/1998 Gaskins et al.
D393,733 S 4/1998 Gaskins et al.
D399,331 S 10/1998 Greene et al.
D399,332 S 10/1998 Greene et al.
D399,333 S 10/1998 Greene et al.
D400,286 S 10/1998 Greene et al.
5,845,988 A 12/1998 Mandall
5,902,035 A 5/1999 Mui
D415,304 S 10/1999 Brown
5,971,558 A * 10/1999 Peel ..... 362/26
5,971,571 A 10/1999 Rose
D418,626 S 1/2000 Herst et al.
6,013,985 A 1/2000 Green et al.
6,042,251 A * 3/2000 McCarthy et al. ..... 362/308
D424,736 S 5/2000 Johnson
D429,362 S 8/2000 Landefeld
D437,958 S 2/2001 Doron, Jr. et al.
D440,692 S 4/2001 Janos et al.
D442,313 S 5/2001 Wojtkowiak et al.
D444,258 S 6/2001 Bradford et al.
6,250,781 B1 6/2001 Straus et al.
D445,943 S 7/2001 Littman
D446,340 S 8/2001 Bradford et al.
D447,590 S 9/2001 Raouf et al.
6,293,510 B1 9/2001 Bradford et al.
6,338,565 B1 1/2002 Fager et al.
D456,551 S 4/2002 Russello et al.
D456,552 S 4/2002 Russello et al.
D456,553 S 4/2002 Russello et al.
D456,926 S 5/2002 Gaskins et al.
D456,927 S 5/2002 Russello et al.
D456,928 S 5/2002 Russello et al.
D456,929 S 5/2002 Russello et al.
D456,930 S 5/2002 Russello et al.
D459,515 S 6/2002 Gaskins et al.
D459,519 S 6/2002 Russello et al.
D460,575 S 7/2002 Tergny et al.
6,422,709 B1 7/2002 Panagiotou
D465,048 S 10/2002 Gaskins et al.
D465,868 S 11/2002 Gaskins et al.
6,474,846 B1 11/2002 Kelmelins et al.
D467,030 S 12/2002 Gaskins et al.
D468,051 S 12/2002 Gaskins et al.
D469,565 S 1/2003 Anderson et al.
D472,339 S 3/2003 Russello et al.
D482,487 S 11/2003 Russello et al.
D494,701 S 8/2004 Campbell
6,830,362 B2 * 12/2004 Mullen ..... 362/455
2002/0131262 A1 9/2002 Amburgey
2003/0035300 A1 * 2/2003 Branstetter ..... 362/549
2003/0151925 A1 * 8/2003 Crunk ..... 362/545
2007/0253199 A1 * 11/2007 Biello et al. ..... 362/267

* cited by examiner

FRONT TRIM RING FOR A VANDAL RESISTANT LUMINAIRE

CROSS-REFERENCE TO RELATED APPLICATIONS

This application under 35 USC § 119(e) claims priority to, and benefit from, U.S. Provisional Application Ser. No. 60/745,900, filed Apr. 28, 2006, entitled "Front Trim Ring for a Vandal Resistant Luminaire," which is currently pending, naming the above-listed persons as joint inventors.

STATEMENT REGARDING FEDERALLY SPONSORED RESEARCH OR DEVELOPMENT

Not applicable.

FIELD OF INVENTION

The present invention relates to luminaires or more specifically an aesthetic and physical shock absorbing front trim ring for a vandal-resistant luminaire.

BACKGROUND OF THE INVENTION

Many existing public locations, both indoor and outdoor, have luminaires installed. Even though these luminaires are intended to benefit the public they are often times an annoyance for a would be vandal or thief. Therefore, luminaires have long have been targeted for disablement or destruction by vandals, thieves, and others seeking to reduce the amount of light present in a given locale. Luminaire electrical component housings and lamps contained within the electrical component housings of such luminaires are typically fragile in construction. Physical impact or even mere jarring can disable a luminaire or even destroy a portion thereof. The damage can occur to the electrical component housing, lamp, lens, or other component thereby extinguishing the light emitted by the luminaire. Attempts have been made to address this problem for those seeking to maintain the functional status of a luminaire in a public place. This has been addressed by constructing armored luminaires which have an armored electrical component housing or by placing the luminaire out of reach to the public. However, the armor has tended to make the luminaire less aesthetic than desired and the locating of the luminaires out of reach often times decreases the ability of the luminaire to light a desired area. The armor and location of the luminaires has also tended to increase maintenance costs associated with keeping the luminaires operational. Recently plastics have been used in the construction of vandal resistant luminaires, however their configuration has not provided the resistance to tampering as is desired.

Thus a need continues to exist for luminaires to resist the attempts of vandals, would-be thieves, and the like from destroying the luminaire or extinguishing the light emitted thereby while providing adequate light, a more aesthetic luminaires and a means for maintaining the luminaire without excessive maintenance costs.

SUMMARY OF THE INVENTION

The present invention relates to a front trim ring for use in a vandal resistant luminaire intended for use in a public area and designed to resist physical damage from impact while providing adequate light, an aesthetic luminaires and an economic means for maintenance. The luminaire trim ring is designed to absorb physical shock placed on the luminaires hold and seal the lens to a housing with electrical components contained therein, provide ease of access to the electrical components, and provide for an aesthetically pleasing luminaire.

Preferably the front trim ring is comprised of a polycarbonate material and more preferably an ultraviolet stabilized polycarbonate material. The preferred method of manufacture is injection molding. The trim ring preferably has a bezel configuration with a twist locking device for retaining a lens to an electrical component housing creating an aesthetic seamless outer surface while eliminating pry or holding points about or between the housing and lens. The front trim ring is configured to retain a lens snugly against an optional gasket on the housing creating a seal there between and to absorb physical shock exerted on the front trim ring to protect the lens and housing from impact. Optionally, a front face covering a portion of or forming a design on the lens may be incorporated into the front trim ring. Alternatively, a front face covering may provide a graphical display area about the lens or other design.

DETAILED DESCRIPTION

The present invention relates to a front trim ring for use in a vandal resistant luminaire intended for use in a public area and designed to resist physical damage from impact while providing adequate light, an aesthetic luminaires and an economic means for maintenance. The luminaire front trim ring depicted in the various figures is selected solely for the purpose of illustrating the invention. Other and different front trim rings may utilize the inventive features described herein. Reference to the Figures showing embodiments are made only for descriptive purposes and are not intended to limit the scope of the claims and disclosure herein.

Figure 1:
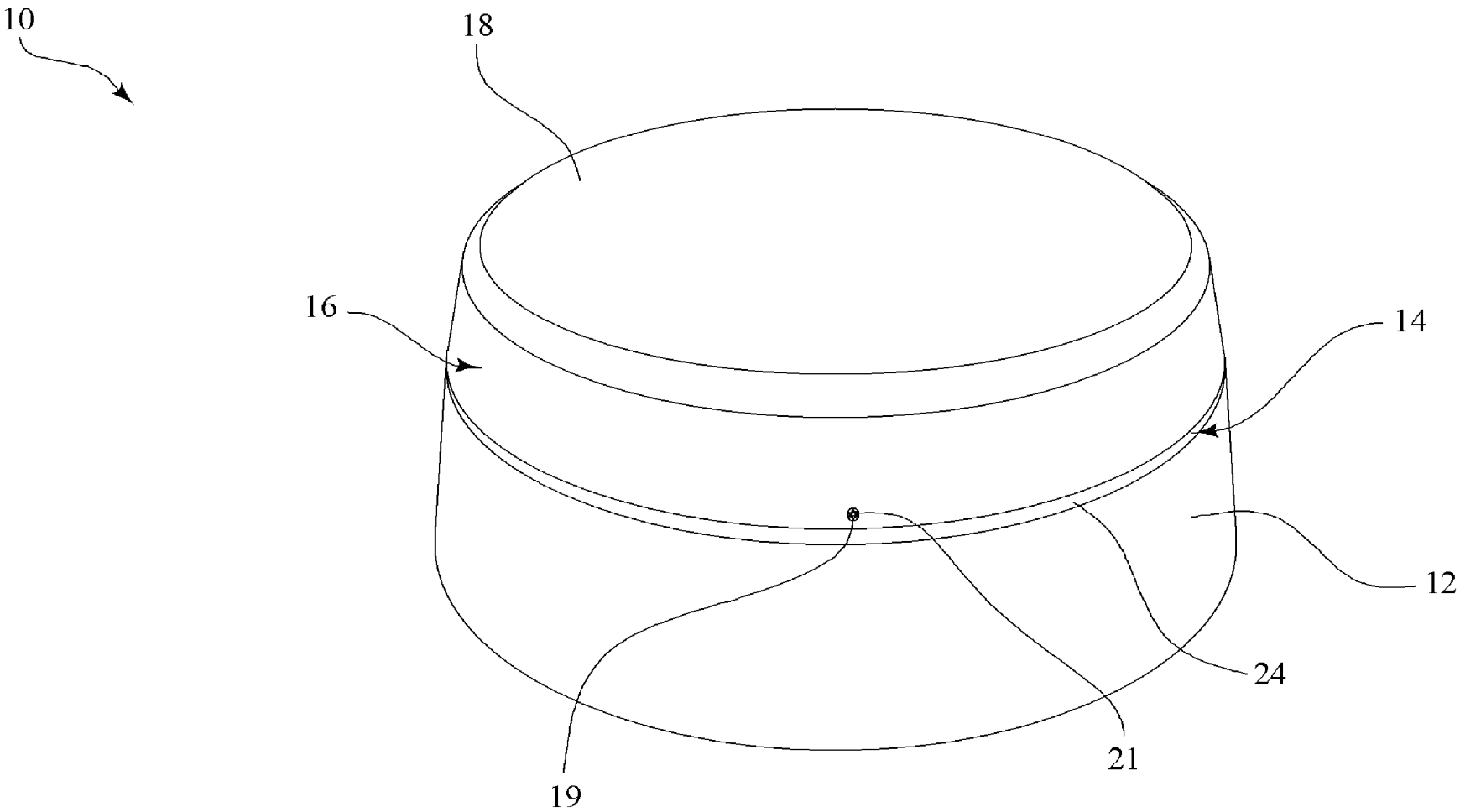
FIG. 1 is a perspective view of a vandal resistant luminaire showing external components thereof and positioning of the front trim ring within the luminaire.

FIG. 1 shows the external components of vandal resistant luminaire 10. Rear trim ring 12 covers a portion of electrical component housing 14 providing an aesthetically pleasing rear side of luminaire 10 while increasing security of luminaire 10 by providing a smooth outer side surface mounting flush against a wall or ceiling reducing hold and pry points. Electrical component housing 14 has an outwardly extending rim 24 visible in fully assembled luminaire 10 between rear trim ring 12 and front trim ring 16. Front trim ring 16 surrounds an outer portion of lens 18 and electrical component housing 12 and locks onto electrical component housing 14 and is held in a locked position with locking fastener 19 extending through locking fastener receptacle 21 in front trim ring 16. Front trim ring 16 holds lens 18 to electrical component housing 14 providing a smooth outer surface for vandal resistant luminaire 10. Front trim ring 16 preferably has a polycarbonate material, an ultraviolet stabilized material, or both and is preferably formed by an injection mold process.

Figure 2:
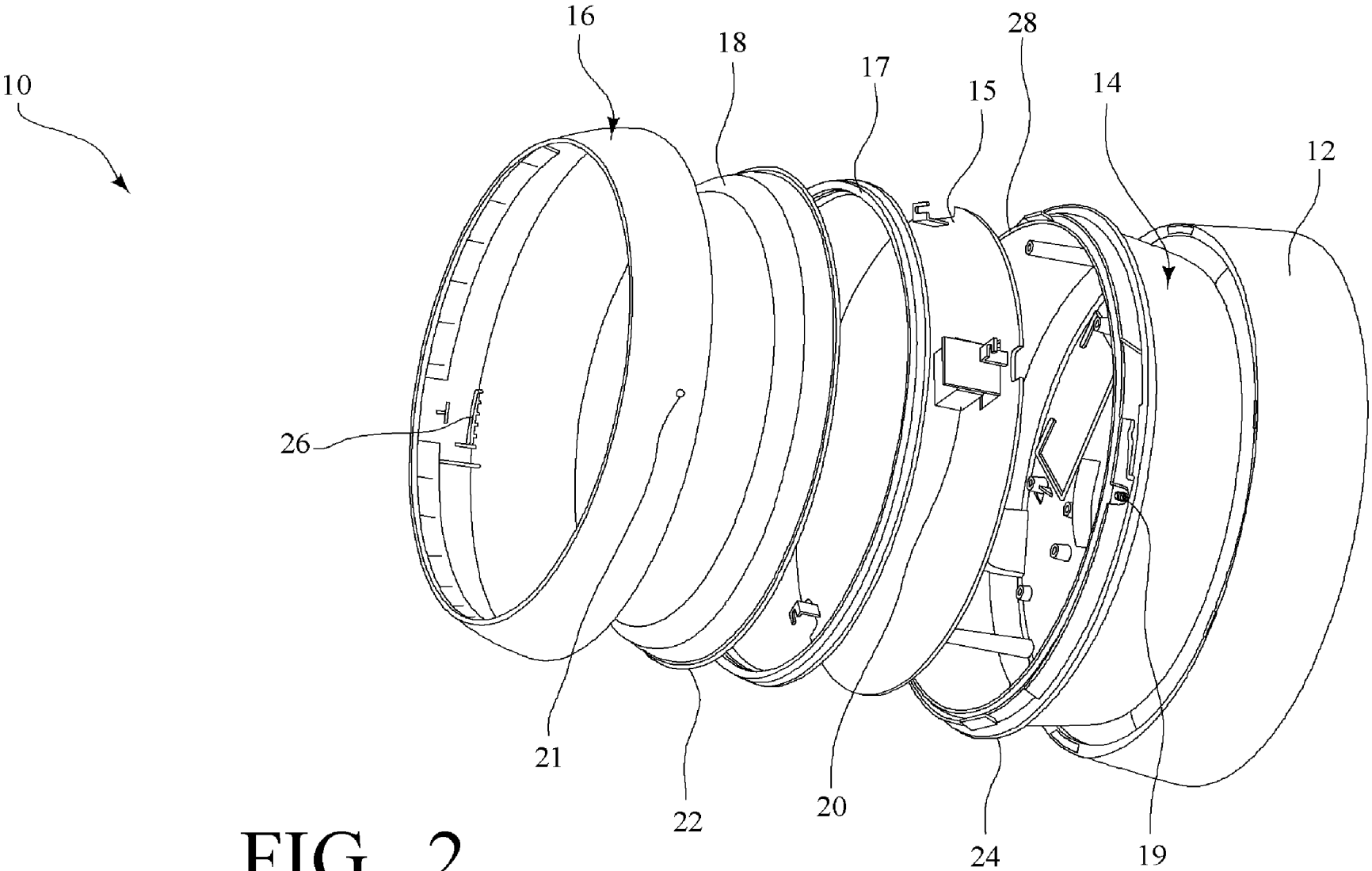
FIG. 2 is an exploded view of the vandal resistant luminaire showing the placement of the front trim ring of FIG. 1 therein.

FIG. 2 shows the internal components of vandal resistant luminaire 10 and the placement of front trim ring 16 therein. Rear trim ring 12 is removed from electrical component housing 14 showing the outer configuration of electrical component housing 14 and cooperation between rear trim ring 12, outer rim 24 of electrical component housing 14, and front trim ring 16. Lamp holder assembly 15 attaches within electrical component housing 14 and has lamp socket 20 on a front surface. The front surface of lamp holder 15 is preferably comprised of a reflective material. Front trim ring 16 holds lens 18 to electrical component housing 14 with gasket 17 there between providing a smooth outer surface for vandal resistant luminaire 10. Gasket 17 is placed about gasket ring 28, both of which are shown having a continuously round configuration, on electrical component housing 14. Front trim ring 16 has twist locks 26 with sloping surfaces for securing about electrical component housing 14 and locking thereto with locking fastener 19 extending into locking fastener receptacle 21 in front trim ring 16. Lens 18 has outer lip 22 that cooperates with front trim ring 16 on a front surface and gasket 17 on a rear surface.

Figure 3:
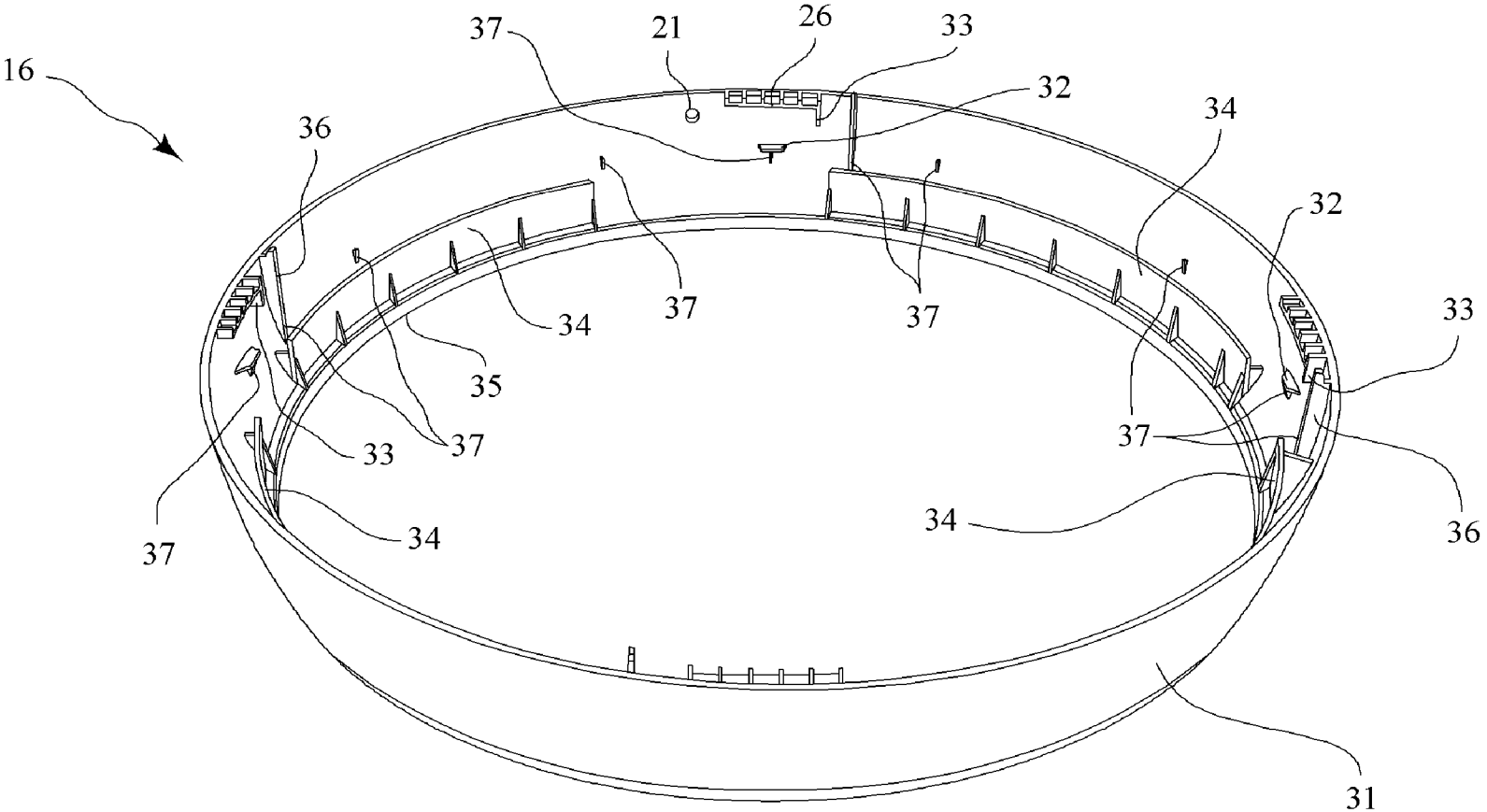
FIG. 3 is a perspective view of the front trim ring of FIG. 1 showing the internal structure for engaging a housing and lens.
Figure 4:
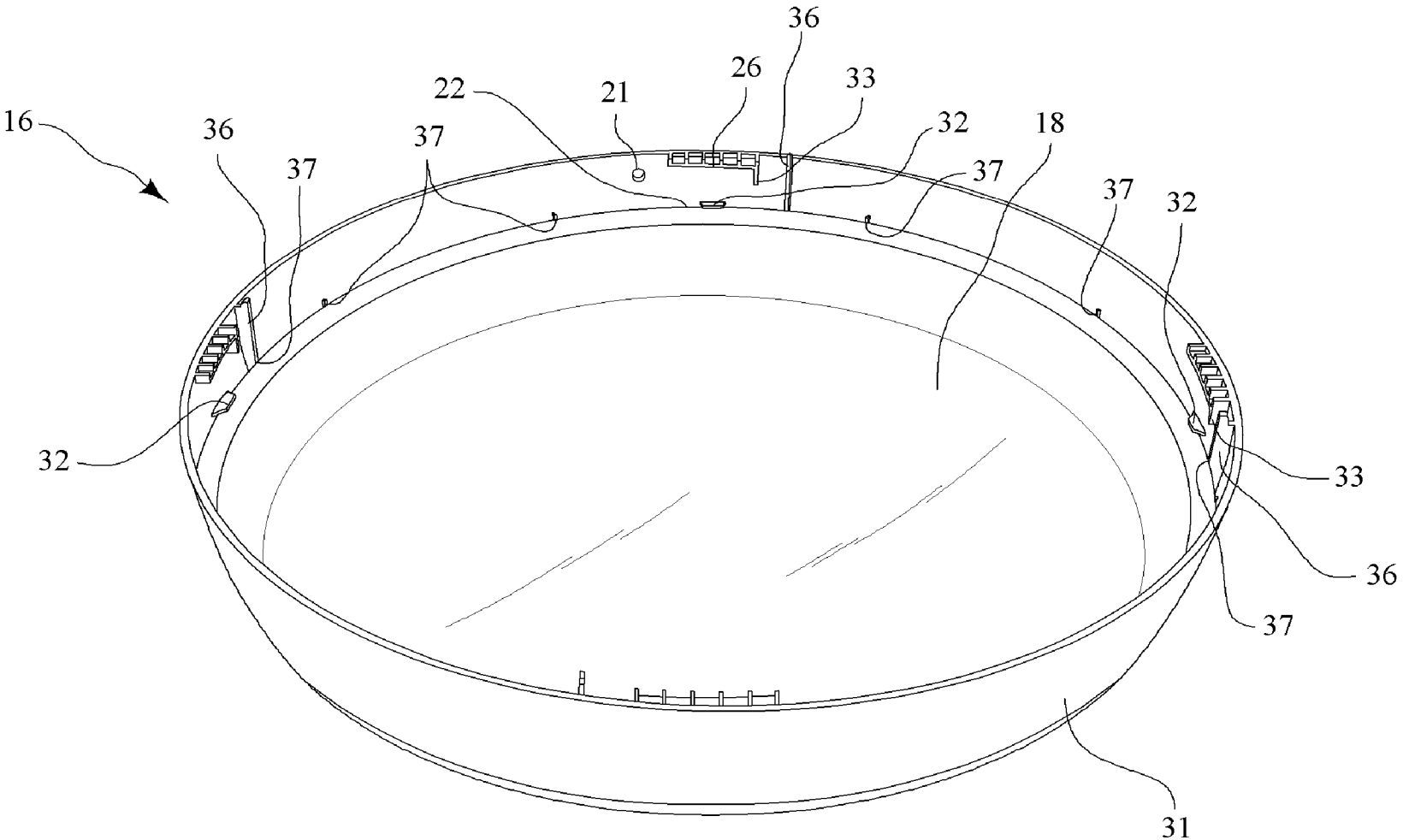
FIG. 4 is a perspective view of the front trim ring of FIG. 1 having a lens mounted therein.

FIGS. 3 and 4 show the internal structure of front trim ring 16 and the cooperation between front trim ring 16 and lens 18. Front trim ring 16 has a shock absorbing bezel configuration. In this embodiment, the shock absorbing configuration includes lens contact projections 37 extending inwardly from and spaced about the internal surface of front trim ring 16. Contact projections 37 contact the outer edge of outer lip 22 of lens 18 and provide a space between the inner wall of outer bezel configured wall 31 and lens 18 as shown in FIG. 4. Lock guides 36 depend from side wall 31 of front trim ring 16 and have a portion projecting beyond the side wall 31. In the embodiment shown, lens contact projections 37 are unitary with lock guides 36. This space improves the shock absorbing capacity of front trim ring 16 by allowing front trim ring 16 to deform prior to the contact between inner wall of outer bezel configured wall 31 and lens 18. This deformation of trim ring 16 absorbs energy of a shock placed thereon prior to side impact with lens 18 thus reducing the shock thereto. Twist locks 26 have a substantially flat sloping surface for securing about electrical component housing 14. Twist stops 33 depend from the sloping surface of twist locks 26 providing an on stop functionality. Lens retainers 34, shown in the form of a series of annular flanges in this embodiment, depend from proximate a front opening toward twist locks 26. Lens retainers 34 have outers edge that cooperate with a slot in the rear side of outer lip 22 of lens 18. Lens retaining tabs 32 cooperate with the outer edge of outer lip 22 holding lens 18 adjacent lens retainers 34. Lens contact projections 37 are shown extending from lens retaining tabs 32. Locking fastener aperture 21 aligns with a locking fastener 19 in electrical component housing 14 when front trim ring 16 is fully engage with electrical component housing 14.

Figure 5A:
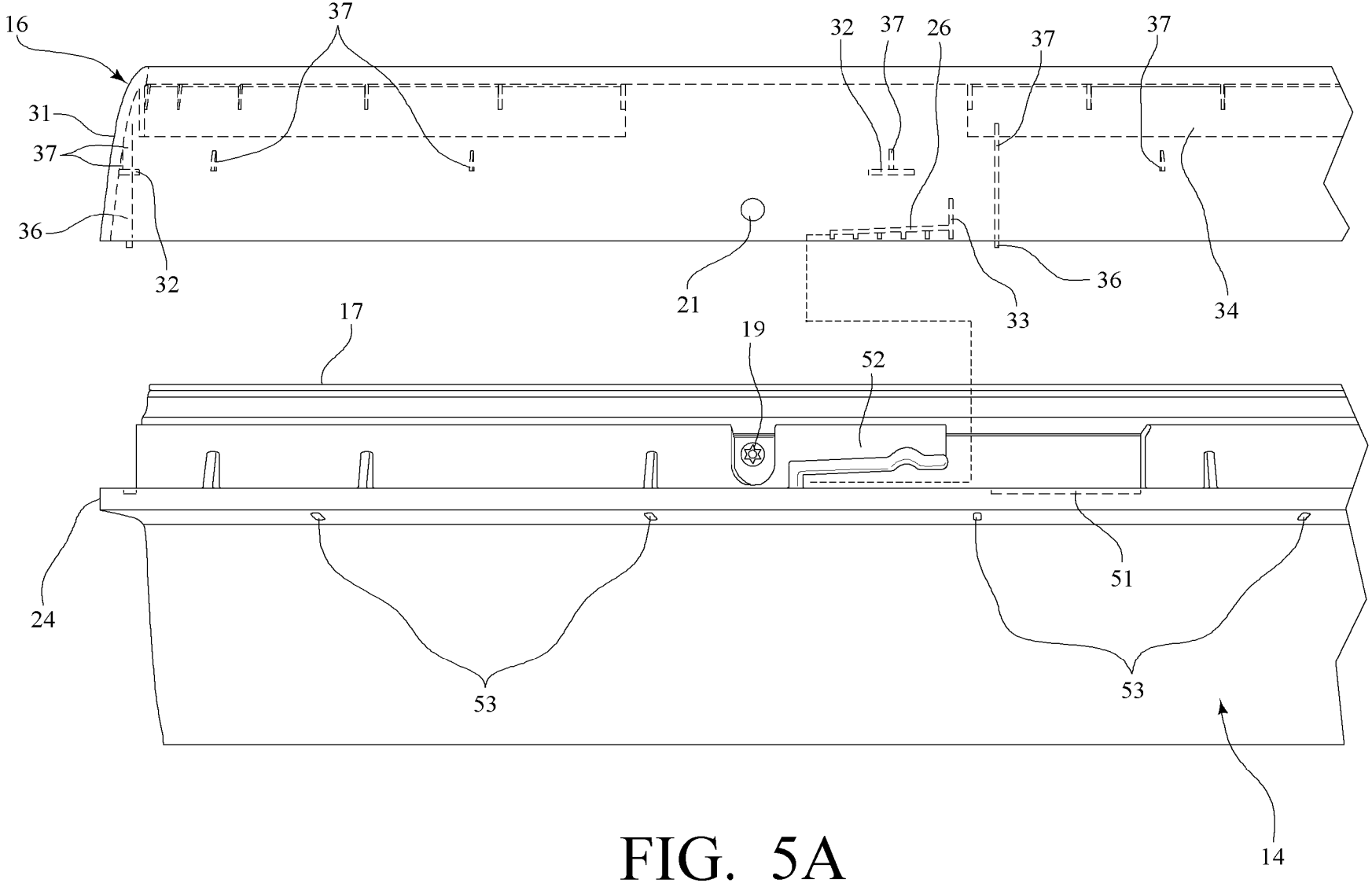
FIG. 5A is cutaway view of the trim ring of FIG. 1 showing it removed from a portion of the housing for receiving same.
Figure 5B:
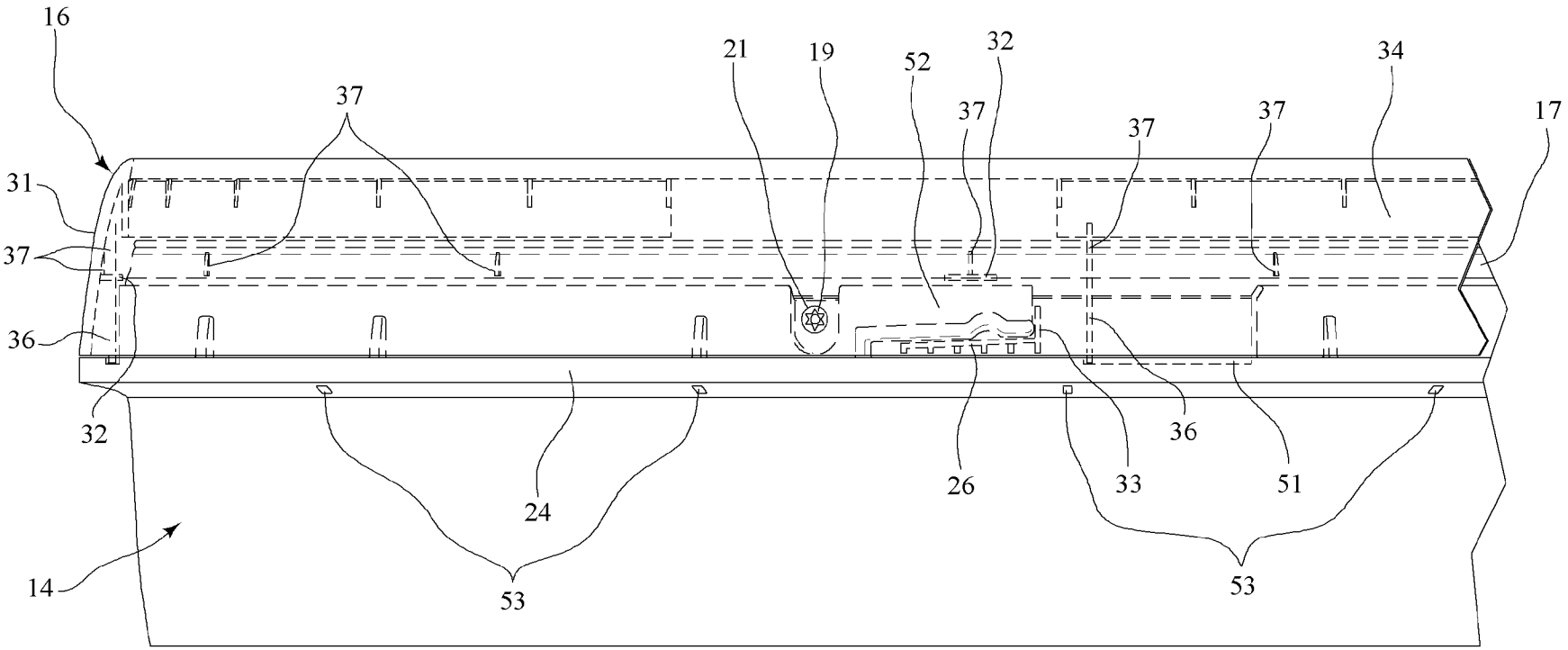
FIG. 5B is cutaway view of the trim ring of FIG. 1 showing it engaged with a portion of the housing.

FIGS. 5A and 5B show the cooperation between front trim ring 16 and electrical component housing 14. FIG. 5A shows front trim ring 16 spaced apart from electrical component housing 14 while FIG. 5B shows it engaged thereon. Twist locks 26 having twist stops 33 are shown engaging retaining leg 52 on electrical component housing 14. Twist stops 33 depend from the sloping surface of twist locks 26 providing an on stop functionality of front trim ring 16 when it is fully engaged on electrical component housing 14. The slope of the surface of twist locks 26 is such that a clockwise rotation of front trim ring 16 on electrical component housing 14 pulls trim ring 16 toward electrical component housing 14. At the point of full engagement, the rear of front trim ring 16 is adjacent outwardly extending rim 24 on electrical component housing 14 and locking fastener 19 aligns with locking fastener receptacle 21 in front trim ring 16. Locking fastener 19 is backed out of electrical component housing 14 into locking fastener receptacle 21 locking front trim ring 16 onto electrical component housing 14. In the embodiment shown here, locking fastener 19 is in the form of a star bolt requiring a special tool for removal adding to the security of vandal resistant luminaire 10. However, it is to be understood that any fastener could be used in place of locking fastener 19. Lock guides 36 depend from the inner side of wall 31 of front trim ring 16 and have a portion projecting beyond the side wall 31 which cooperate with lock guide slots 51 in electronic component housing 14. Lens contact projections 37 are unitary with lock guides 36 and depend upward from a bottom portion thereof. Lens contact projections 37 are shown extending from lens retaining tabs 32 and independently spaced about the inner side of side wall 31. Slots 53 are shown in a lower side of outwardly extending rim 24 which cooperate with an optional rear trim ring 12. When front trim ring 16 is engaged on electronic component housing 14, it surrounds gasket 17 residing on an outer rim of electrical component housing 14. Lens retainers 34 are a series of annular flanges extending from proximate a front opening toward twist locks 26.

Figure 6:
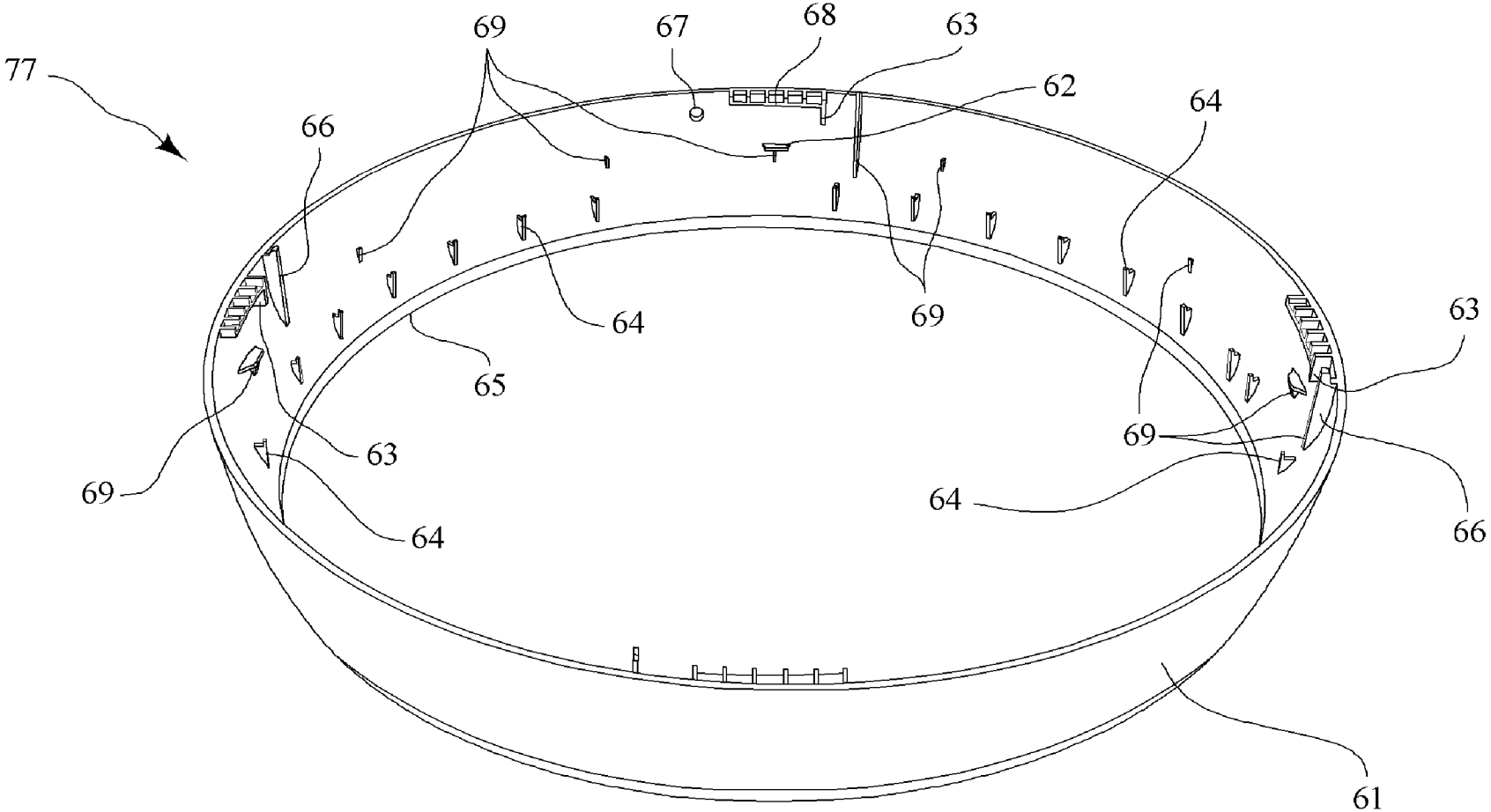
FIG. 6 is a perspective view of an alternative embodiment of a front trim ring showing the internal structure for engaging a housing and lens.

FIG. 6 shows another embodiment of a front trim ring. Front trim ring 61 has twist locks 68 having twist stops 63. Twist stops 63 depend from the sloping surface of twist locks 68 providing an on stop functionality of front trim ring 61 when it is fully engaged on electrical component housing 14. The slope of the surface of twist locks 68 is such that a clockwise rotation of front trim ring 61 on electrical component housing 14 pulls trim ring 16 toward electrical component housing 14. At the point of full engagement, the rear of front trim ring 61 is adjacent outwardly extending rim 24 on electrical component housing 14 and locking fastener 19 aligns with locking fastener receptacle 67 in front trim ring 61. Lock guides 66 depend from the inner side of wall 77 of front trim ring 61 and have a portion projecting beyond the side wall 77 which cooperate with lock guide slots 51 in electronic component housing 14. A portion of lens contact projections 69 are unitary with lock guides 66 and depend from a front portion thereof. A portion of lens contact projections 69 are shown extending from lens retaining tabs 62 and others placed about an inner side of side wall 77. When front trim ring 61 is engaged on electronic component housing 14, it surrounds gasket 17 residing on an outer rim of electrical component housing 14. Lens retainers 64 are a series of retaining spurs extending from an inner annular surface of side wall 77 proximate a front opening of front trim ring 61 and extend toward twist locks 68.

Figure 7:
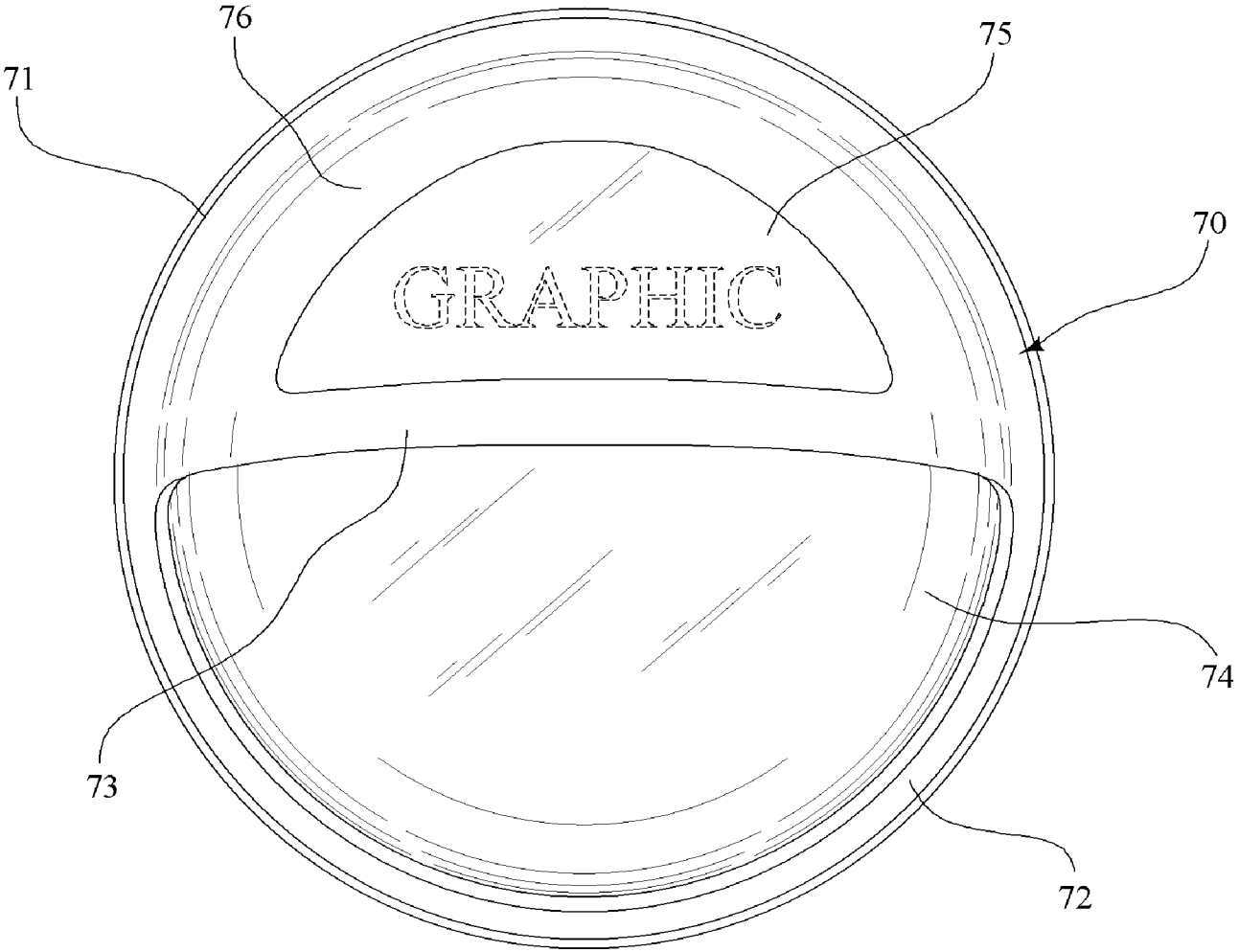
FIG. 7 is a perspective view of an alternative embodiment of a front trim ring showing an open eyelid cover having a graphical display area.
Figure 8:
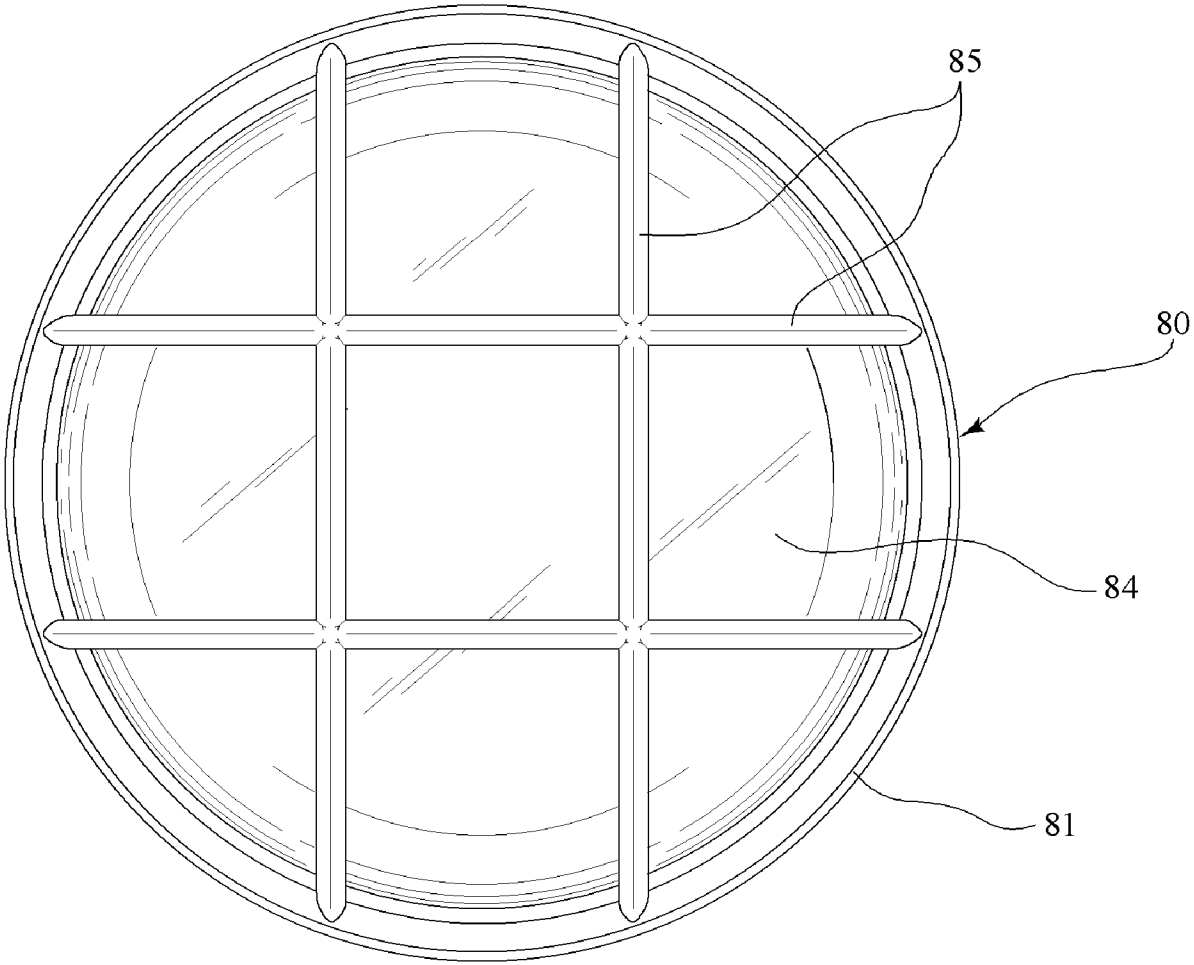
FIG. 8 is a perspective view of yet another embodiment of a front trim ring showing a grid about a lens.

FIGS. 7 and 8 show alternative fronts on a front trim ring. In FIG. 7, front trim ring 70 is an open eyelid cover having annular side wall 71 in a substantially bezel configuration. Extending inward from annular side wall 71 is a graphical display divider 73 separating the illumination of a lamp contained therein into two distinct areas. A graphical display area 75 is provided about the lens and is defined with graphical outer trim 76 and graphical display divider 73 and forms the open eyelid. Graphical outer trim 76 depends inward from annular side wall 71 defining the outer perimeter of graphical display area 75. Graphical display area 75 can incorporate any type of graphical overlay, preferably transparent or translucent, such as a logo, an illuminated scene, or even an advertisement. The other area defined by graphical display divider 73 is illumination area 74 which has outer trim 72 extending inward from annular side wall 71 defining the outer perimeter of illumination area 74. FIG. 8 shows vandal resistant luminaire 80 having a grid pattern about lens 84. The grid pattern is formed with cross members 85 extending inward from annular side wall 81. Luminaires 70 and 80 provide examples of embodiments of alternative lens covering portions of the front trim ring, persons having ordinary skill in the art may provide yet other embodiments without departing from the scope of the claims herein as such will become evident upon reading this disclosure.

We claim:

1. A vandal resistant luminaire comprising:

a front trim ring, said front trim ring surrounding an outer portion of a lens and an outer portion of an electrical component housing and holding said lens to said electrical component housing, said front trim ring having at least one lens retainer contacting an outer lip of said lens, said outer lip of said lens retained between said at least one lens retainer and at least one inwardly directed lens retaining tab;

said front trim ring further having a plurality of inwardly directed contact projections, said plurality of contact projections contacting said outer lip of said lens and providing a space between said front trim ring and said lens, said space capable of absorbing physical shock to protect said vandal resistant luminaire from physical shock exerted thereto, said front trim ring having at least two inwardly extending twist locks with axially sloping surfaces positioned to engage retaining legs proximate a front rim of said electrical component housing.

2. The vandal resistant luminaire of claim 1 wherein said front trim ring has a portion extending about said lens forming an open eyelid thereon.

3. The vandal resistant luminaire of claim 2 wherein said open eyelid has a graphical display in the form of an eyelid insert therein.

4. The vandal resistant luminaire of claim 1 wherein said front trim ring has cross members extending over said lens forming a grid pattern thereon.

5. The vandal resistant luminaire of claim 1 wherein the rear of said front trim ring is adjacent an outwardly extending rim on said electrical component housing.

6. The vandal resistant luminaire of claim 1 wherein said front trim ring surrounds a gasket between said lens and said electrical component housing and sealing said lens to said electrical component housing when said twist locks are engaged with said retaining legs.

7. The vandal resistant luminaire of claim 1 wherein said front trim ring comprises a polycarbonate material.

8. The vandal resistant luminaire of claim 1 wherein said front trim ring comprises an ultraviolet stabilized material.

9. The vandal resistant luminaire of claim 1 wherein said front trim ring has a bezel configuration.

10. The vandal resistant luminaire of claim 1 wherein said lens retainer is a series of annular flanges extending from proximate a front opening toward said twist locks.

11. The vandal resistant luminaire of claim 1 wherein said front trim ring has a locking fastener aperture aligned with a locking fastener engaged with said electrical component housing when said twist locks are fully engaged with said retaining legs.

12. A vandal resistant luminaire comprising:

an electrical component housing having a plurality of retaining legs proximate a round front opening, said electrical component housing having at least one lamp socket and associated wiring contained therein;

a lens having a round rear opening proximate said round front opening in said electrical component housing;

a front trim ring surrounding said openings of said electrical component housing and said lens, said front trim ring having twist locks extending from an inner annular surface with upwardly sloping top surfaces positioned to engage said plurality of retaining legs and compress said lens between said electrical component housing and said front trim ring;

a plurality of upwardly extending lens retainer flanges contacting a peripheral lip of said lens, said peripheral lip of said lens retained between said lens retainer flanges and a plurality of lens retaining tabs spaced about an interior wall of said front trim ring;

said front trim ring further having a plurality of contact projections spacing said peripheral lip of said lens from said interior wall of said front trim ring creating a peripheral space there between;

said peripheral space able to absorb impacts and other forces improving shock absorbing capacity of said front trim ring by allowing said front trim ring to deform prior to contact between said interior wall of said front trim ring.

13. A front trim ring for a vandal resistant, comprising:

a luminaire surrounding an outer portion of a lens and an outer portion of an electrical component housing of said luminaire and holding said lens proximate said electrical component housing, said front trim ring having a shock absorbing configuration to protect said vandal resistant luminaire from physical shock exerted thereto, said configuration including a plurality of inwardly extending contact projections extending from an inner side wall of said front trim ring, said side wall of said front trim ring being upwardly and inwardly angled from said electrical component housing, said upwardly and inwardly angled front trim ring wall forming a bezel configured wall;

said plurality of inwardly extending contact projections creating a shock absorption space between said front trim ring wall and said lens;

said front trim ring having at least two inwardly extending twist locks engaging said electrical component housing allowing said front trim ring to be rotationally installed and locked on said electrical component housing, said inwardly extending twist locks having upwardly sloping top surfaces acting as a partial helical thread.

14. The front trim ring of claim 13 wherein said at least two inwardly extending twist locks have upwardly sloping top surfaces positioned to engage retaining legs extending from an outer surface of said electrical component housing proximate a front opening therein, said front trim ring further having lock guides extending beyond a peripheral edge of said front trim ring, said long guides mating with lock guide slots formed on an outwardly extending rim of said electrical component housing.

15. The front trim ring of claim 14 having a locking aperture for receiving a portion of a fastener cooperating with said electrical component housing.

16. The front trim ring of claim 14 having a front portion extending about said lens.

* * * * *